US009004794B2

(12) United States Patent
Whigham

(10) Patent No.: US 9,004,794 B2
(45) Date of Patent: Apr. 14, 2015

(54) TELESCOPING CHALK HOLDER

(71) Applicant: Christopher Whigham, Leawood, KS (US)

(72) Inventor: Christopher Whigham, Leawood, KS (US)

( * ) Notice: Subject to any disclaimer, the term of this patent is extended or adjusted under 35 U.S.C. 154(b) by 0 days.

(21) Appl. No.: 13/797,528

(22) Filed: Mar. 12, 2013

(65) Prior Publication Data

US 2014/0270890 A1 Sep. 18, 2014

(51) Int. Cl.
*B43K 21/22* (2006.01)
*B43K 23/016* (2006.01)
*B43K 24/00* (2006.01)

(52) U.S. Cl.
CPC ..... *B43K 23/016* (2013.01); *B43K 24/00* (2013.01)

(58) Field of Classification Search
CPC .... B43K 21/00; B43K 21/003; B43K 21/006; B43K 21/02; B43K 21/027; B43K 21/06; B43K 21/16; B43K 21/22; B43K 23/016
USPC ..... 401/88, 55–57, 92–94
See application file for complete search history.

(56) References Cited

U.S. PATENT DOCUMENTS

| | | | | |
|---|---|---|---|---|
| RE5,518 | E | 8/1873 | Downes | |
| 959,531 | A | 5/1910 | Hollenberger | |
| 1,378,174 | A * | 5/1921 | Kaiser | 401/65 |
| 2,287,384 | A * | 6/1942 | Martines | 401/93 |
| 2,312,136 | A * | 2/1943 | Van Triest | 401/48 |
| 2,687,116 | A * | 8/1954 | Sheets | 401/93 |
| 3,469,927 | A | 9/1969 | Aversa | |
| 3,603,693 | A * | 9/1971 | Mori et al. | 401/81 |
| 4,610,556 | A | 9/1986 | Tsai | |
| 5,292,202 | A * | 3/1994 | Lee | 401/57 |
| 5,509,743 | A | 4/1996 | Hao | |
| 5,957,601 | A | 9/1999 | Weiss | |
| 6,149,330 | A | 11/2000 | Chuang | |
| 6,241,410 | B1 * | 6/2001 | Hager | 401/89 |
| 6,276,854 | B1 | 8/2001 | Mullins | |
| D475,085 | S | 5/2003 | Whitehorn | |
| 6,793,429 | B2 * | 9/2004 | Arrison | 401/93 |
| 6,811,339 | B1 | 11/2004 | Tsaur | |
| D502,215 | S | 2/2005 | Hung | |
| 6,899,483 | B1 | 5/2005 | Ho | |
| 7,232,270 | B1 * | 6/2007 | Goldstein | 401/93 |
| 7,431,528 | B2 | 10/2008 | Liu | |
| 7,806,614 | B2 | 10/2010 | Desson | |
| 2003/0000960 | A1 | 1/2003 | Cirlin | |
| 2005/0135862 | A1 | 6/2005 | Ho | |
| 2008/0075520 | A1 | 3/2008 | Grossman | |
| 2008/0145133 | A1 | 6/2008 | Palmer | |
| 2010/0272495 | A1 | 10/2010 | Srnensky | |
| 2011/0250004 | A1 | 10/2011 | Chung | |

* cited by examiner

*Primary Examiner* — David Walczak
(74) *Attorney, Agent, or Firm* — Intellectual Property Center, LLC; Arthur K. Shaffer

(57) ABSTRACT

A telescopic chalk holder for drawing upon a drawing surface and including an outer cylinder having a tip at one end, a chalk stick received within the outer cylinder, the tip in radial receipt of the chalk stick, a push rod received by a second end of the outer cylinder and extending at least a portion of the chalk stick through the tip, and a push rod providing pressure to the chalk stick as the tip is manipulated over the drawing surface.

5 Claims, 2 Drawing Sheets

TELESCOPING CHALK HOLDER

FIELD OF THE INVENTION

The present invention is directed to a drawing instrument holder and more particularly directed towards a telescopic chalk holding apparatus for holding a plurality of chalk pieces for continuous use and storage.

BACKGROUND OF THE INVENTION

When drawing using large pieces of chalk commonly known as sidewalk chalk, or sidewalk chalk sticks, it is common to run out of chalk. Sidewalk chalk is typically marketed for outdoor use for writing and drawing on hard surfaces, typically sidewalks, paved drive-ways or other paved surfaces. However, the large surfaces being drawn upon require a large amount of chalk to complete a drawing. In addition, the surface being drawn upon is rough and hard, which quickly exhausts a supply of chalk. In some cases, a stick of chalk can last a matter of seconds before the user must find a new chalk stick. In addition, generally each stick must be discarded prior to exhaustion to avoid unnecessary scrapes and scratches which may result from contact with the underlying rough surface. Additionally, during use the user may need to assume a bent, squatting, or seated position to mark on ground-level surfaces with this chalk. For purposes of the present application, references to ground level surfaces are meant to cover any horizontal surface upon which a user may draw, and may include ground, floor or elevated surfaces.

Sidewalk chalk is commonly available in cylindrical shape, usually slightly tapered, and in a variety of colors. It is also available in a wide variety of shapes. Characteristically, sidewalk chalk differs in size from that of other conventional chalk such as is used for writing on classroom blackboards. Typical sidewalk chalk sticks are approximately one inch in diameter at one end, tapered to ⅞ inch at the other end and are approximately 4 inches in length. The smaller conventional chalk is inherently more prone to accidental breakage. Some of the prior art cited below is inspired by the need to prevent breakage in the smaller chalk.

Various types of chalk holding devices have been disclosed in the prior art. Some are designed for use in a conventional manner by grasping the device in one hand held close to the writing surface. Examples include U.S. Pat. Nos. 2,205,907; 5,048,989; 4,468,146; 2,181,202; 5,779,381; 3,603,693; 332,157; and 354,311. U.S. Pat. No. 389,517 discloses a hand held apparatus that holds three pieces of chalk parallel to one another for drawing lines in triplicate. Other specialized chalk holding devices are disclosed for use in marking livestock as disclosed in U.S. Pat. No. 332,157.

While these devices may fulfill their respective, particular objectives and requirements, the aforementioned patents do not disclose the present invention, a telescoping chalk holder, which allows for continued use during operation without the need to manually add each chalk stick. The present device includes a generally cylindrical outer and inner tube of a length and diameter capable of holding at least two large sticks of chalk, commonly referred to as sidewalk chalk. Furthermore, the new device permits for the continued drawing during telescopic use from an elevated position while manipulating the chalk on the ground.

Among the prior art, four devices are known that permit marking with chalk on or near a ground level surface from a generally upright position. U.S. Pat. No. 5,895,072 discloses an attachment for securing chalk to in-line roller skates, an obviously restricted use. A tire marking device comprising a handle and collet extending at an angle away from the longitudinal axis of the handle is disclosed in U.S. Pat. No. 2,687,116. A device with an elongated shaft and a lower curved portion for marking automobile tires is disclosed in U.S. Pat. No. 5,931,592. The tire marking devices are designed for marking surfaces roughly parallel to the upright human user. U.S. Pat. No. 6,241,410 discloses a handle gripped tube with a top oriented storage area and a bottom shaped tip for receiving and holding a single chalk stick.

These devices do not lend themselves to continued drawing in an elevated position for marking on a lower ground surface. These devices also do not allow for adjustment. Various chalk drawers may draw at different speeds or with different downward force. Allowing for adjustment of the drawing implement to account for varying speeds and forces would also be beneficial.

SUMMARY OF THE INVENTION

The present invention provides a telescoping chalk holder for holding a plurality of chalk pieces for drawing on a drawing surface. In accordance with one embodiment of the present invention, a telescopic chalk holder for drawing upon a drawing surface the holder including an outer cylinder having a tip at one end a chalk stick received within the outer cylinder, said tip in radial receipt of the chalk stick, a push rod received by a second end of said outer cylinder and extending at least a portion of said chalk stick through said tip, and the push rod providing pressure to said chalk stick as said tip is manipulated over a drawing surface. The invention may further include a removable cap and an adjustable tip for adjusting the frictional holding surface which holds the chalk pieces.

Use of this invention provides for broad drawing opportunities making recreational, occupational or outdoor design easier and quicker. Some examples of potential uses of the present invention include, but are not limited to, large scale markings such as a quick layout of boundaries for hard court basketball, street hockey and other recreational activities. Along with the new uses readily apparent is the widened consumer appeal. Specifically, children, adults and persons with disabilities will be able to draw with sidewalk chalk more readily. In addition, the invention helps to minimizing direct contact with chalk dust or messy drawing implements. Further objects and advantages of my invention will become apparent from a consideration of the drawings and ensuing description.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
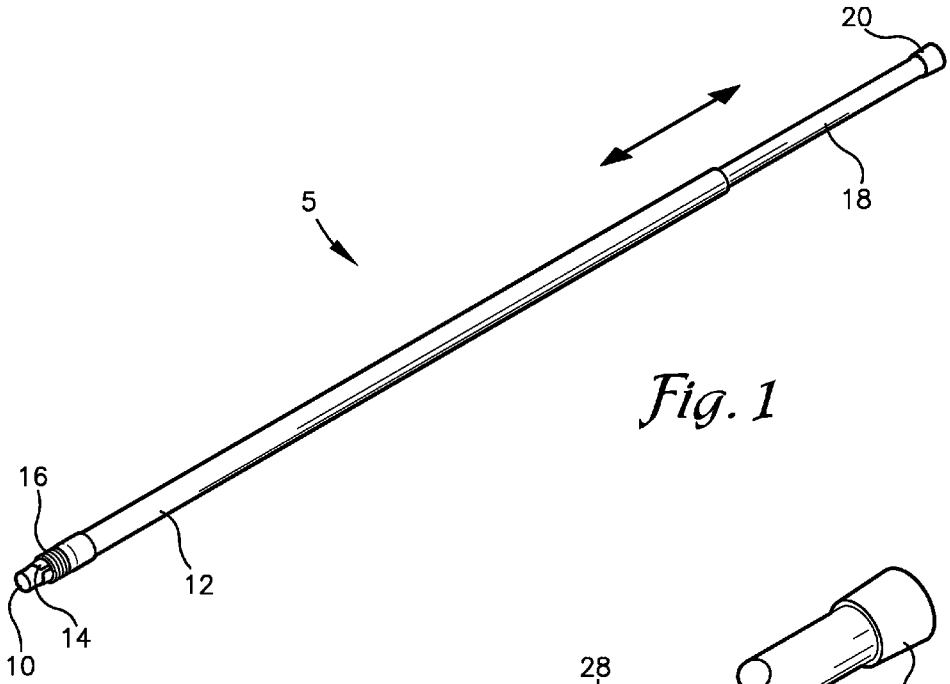
FIG. 1 is an perspective view of an embodiment of the improved chalk holder in accordance with one embodiment of the present invention.

An embodiment of the telescoping chalk holder 5 is disclosed for continued chalk drawing in FIG. 1. The telescoping chalk holder includes an outer cylinder 12 and an inner push rod, also referred to as an inner cylinder 18. The outer cylinder 12 has an inner diameter greater than the outer diameter of the push rod 18 and is adapted for telescopic receipt of the push rod 18. The push rod 18 has a cylindrical sidewall, which extends the length of the push rod 18.

While various dimensions would be suitable, in one embodiment, the inner diameter of the push rod 18 would be less than ⅞ of an inch and the inner diameter of the outer cylinder 12 would be approximately an inch. In addition, each of the inner and outer cylinders 18, 12 may be fabricated from a variety of materials, including plastic or metal, having sufficient strength to operate from a height of between 1.5 and 5 feet. As the telescopic chalk holder 5 extends from an elongated to a compressed position, the height of the device 5 generally corresponds to the amount of received chalk 10. With the telescopic movement of the push rod 18 and the outer cylinder 12, the overall height of the invention 5, in one embodiment, may vary between 2.5 to 5 feet during use and as desired by the operator. However, other heights are contemplated by the present invention from approximately 8" or more.

A tip 22 is located at a distal end of the outer cylinder 12. The tip 22 includes a cylindrical base 14*a* for receipt by the distal end of the outer cylinder 12 and a conical section 14*b* designed for releasable frictional contact with the chalk 10. As the telescopic chalk holder 5 is removed from the underlying horizontal surface, the tip 22 limits undesired movement of the chalk 10.

Figure 2:
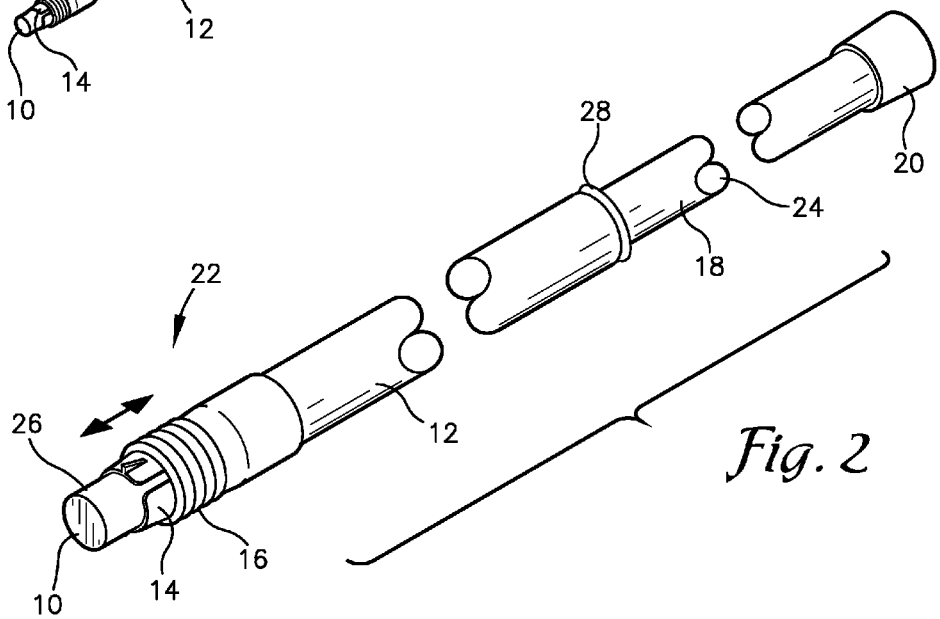
FIG. 2 is a fragmentary sectional view of a improved chalk holder in accordance with the embodiment of FIG. 1.

A sleeve 16 may also be provided on the tip 22 for radial adjustment of the tip 22. The sleeve 16 may be a threadable sleeve which allows for rotational adjustment by rotating the sleeve in a counter or clockwise fashion. In this manner, the operator may compress or decompress the tip 22 and thereby adjust the applied frictional forces at the tip to provide the desired operational properties of the telescopic chalk holder 5. Alternatively, a floating sleeve 16, like the one illustrated in FIG. 2, may be provided which moves over the tip 22 during use and may retract to the cylindrical base 14*a* non-use. As the tip 22 expands or contracts radially during receipt of the chalk 10, the floating sleeve 16 may rise or fall to the proper radial dimension where it will provide the proper circumferential pressure to retain the chalk 10 within the tip 22. In addition, a sleeve retainer 14*c* may be provided to limit undesired movement of the threadable sleeve 16 during operation. The sleeve retainer 14*c* also provides a visual point of reference on the outer cylinder 12 to help align the holder as desired during operation.

In the illustrated embodiment, the conical section 14*b* is shown as a collet, however other configurations are possible to provide the desired frictional contact with the chalk 10 during use. As the floating sleeve 16 is adjusted the collet tip narrows or widens for frictional engagement of the collet tip 14 with the received chalk 10. The cylindrical base 14*a* has an outer diameter less than but similar to the inner diameter of the outer cylinder 12 while the inner diameter of the proximate end of the cylindrical base 14*a* is greater than the outer diameter of the received chalk 10.

A biasing means is further provided which, during telescopic movement from an elongated position to a compressed position, exerts pressure upon a first chalk stick 10*a*. The pressure is then transferred by the first chalk stick to a second chalk stick 10*b* which it is in communication with. As a result of the biasing means, the first and second chalk sticks 10*a*, 10*b* are biased towards the outer cylinder distal end 12*a* associated with the outer cylinder 12 and presenting an exterior drawing tip 26 extending from the outer cylinder 12 towards the drawing surface (not shown).

The biasing means may include a spring (not shown) extending from a push rod proximal end 18*b* associated with the push rod 18 directed towards the first chalk stick 10*a*. The outward pressure presented by the biasing means in communication with the frictional force at the tip 22 extends a portion of the second chalk stick 10*b* from the distal end of the outer cylinder 12, presenting the drawing tip 26. The spring (not shown) may extend from a cap 20, associated with the proximal end 18*b* of the push rod 18, towards the first chalk stick 10*a*. The cap 20 and spring may also be removable as desired. In addition, the cap 20 may be used to help indicate when it is time to replenish the chalk sticks 10 and act as a handle to limit the telescoping movement and allow for removal of the push rod 18 from within the outer cylinder 12. Additional and alternatively a sealing ring may be provided between the pushrod 18 and the outer cylinder 12 to prevent undesired pinching during telescopic operation of the pushrod 18.

Figure 3:
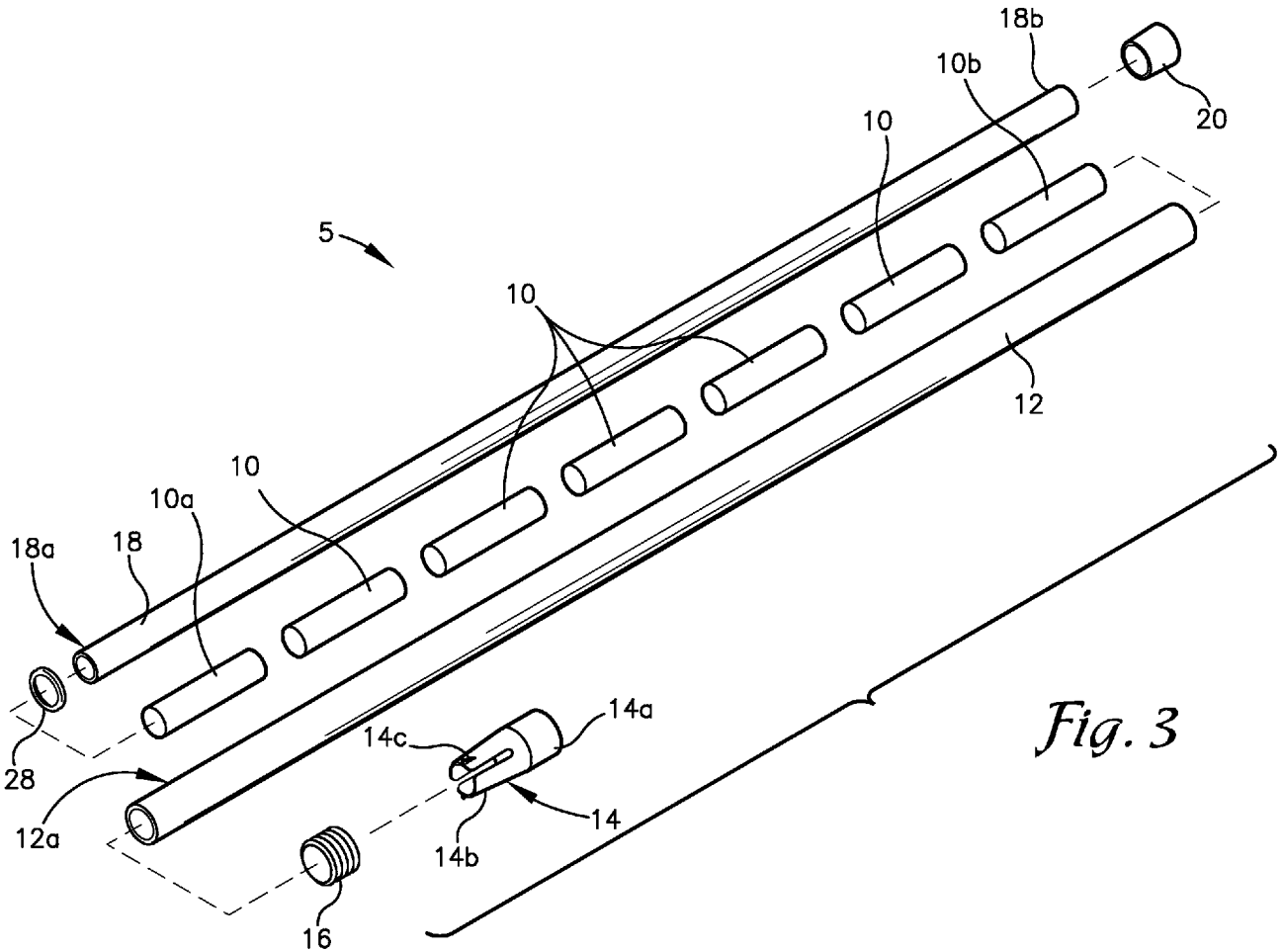
FIG. 3 is an exploded sectional view in accordance with the embodiment of FIG. 1.

As illustrated in FIG. 3, the push rod 18 is configured for removable receipt of the chalk sticks 10, or for removing any received chalk sticks 10. In the illustrated embodiment, the biasing means includes a mechanical biasing means, the push rod 18. As the push rod 18 is compressed, the push rod distal end 18*a* is telescoped inwardly, the first chalk stick 10*a* is urged forward, and the second chalk stick 10*b*, in communication with the first chalk stick 10*a* is outwardly biased. In this configuration, at least one of the chalk sticks 10, preferably the first chalk stick 10*a*, has an outer diameter greater than the inner diameter of the push rod 18 with the push rod distal end 18*a* presenting the desired contact upon the first chalk stick 10*a*.

During telescopic operation of the present invention 5, the push rod 18 is compressed inwardly from the elongated to the compressed position and the second chalk stick 10*b* is outwardly biased, the drawing tip 26 being presented as the second chalk stick 10*b* is urged from the outer cylinder distal end 12*a* towards the drawing surface. The push rod 18 continues to exert an outward bias to the chalk sticks, allowing for continued drawing as the chalk tip 26 of the chalk holder 5 is applied to the horizontal surface.

Additional and alternatively, a radial spacer (not shown) may be providing in communication with the biasing means, providing for alignment of the bias means with the chalk sticks 10 during telescopic movement of the present invention 5. The radial spacer is dimensioned to have sufficient radial dimension for communication between the biasing means and the first chalk stick 10*a* for use upon the drawing surface.

The present invention may also include an outer visual surface wrapped around the push rod 18 and outer cylinder 12 to enhance the visual appearance of the invention.

It is to be understood that while certain forms of the present invention have been illustrated and described herein, it is not to be limited to the specific forms or arrangement of parts described and shown.

What is claimed and desired to be secured by Letters Patent:

1. A telescopic chalk holder for drawing upon a drawing surface said holder comprising:

an outer cylinder having a tip at one end, a chalk stick received within said outer cylinder, said tip in radial receipt of said chalk stick, a sleeve placed over said tip, a push rod received by a second end of said outer cylinder and extending at least a portion of said chalk stick through said tip, and said push rod exerting pressure upon said chalk stick as said tip is manipulated over a drawing surface.

2. The telescopic chalk holder of claim 1 wherein said sleeve adjusts said tip for frictional engagement with said chalk stick.

3. The telescopic chalk holder of claim 1 wherein said push rod includes a cap on a second end of said push rod.

4. The telescopic chalk holder of claim 1 further comprising a visual indicia wrapped around said outer cylinder and said push rod.

5. A telescopic chalk holder for drawing upon a drawing surface said holder comprising:

an outer cylinder having a tip at one end, a first and second chalk stick received within said outer cylinder, said tip in radial receipt of said second chalk stick, a sleeve placed over said tip wherein said sleeve adjusts said tip for frictional engagement with said second chalk stick;

a push rod received by a second end of said outer cylinder and extending at least a portion of said second chalk stick through said tip, and said push rod exerting pressure upon said first chalk stick as said tip is manipulated over a drawing surface.

* * * * *